United States Patent [19]

Gurcan et al.

[11] Patent Number: 4,806,890

[45] Date of Patent: Feb. 21, 1989

[54] TUNEABLE MICROWAVE FILTER

[75] Inventors: Mustafa Gurcan, Osny; Maurice Bernaud, Asnieres, both of France

[73] Assignee: Alcatel Thomson Faisceaux Hertziens, Cedex, France

[21] Appl. No.: 154,409

[22] Filed: Feb. 10, 1988

[30] Foreign Application Priority Data

Feb. 11, 1987 [FR] France ..... 87 01718

[51] Int. Cl.[4] ..... H01P 1/203

[52] U.S. Cl. ..... 333/205; 333/204; 333/246

[58] Field of Search ..... 333/202, 205, 246, 247, 333/219, 223, 204, 174; 334/15, 41, 45

[56] References Cited

U.S. PATENT DOCUMENTS

| | | | |
|---|---|---|---|
| 2,915,716 | 12/1959 | Hattersley | 333/204 |
| 3,530,411 | 9/1970 | Sear | 333/243 |
| 4,023,125 | 5/1977 | Wolfe | 333/238 |
| 4,078,217 | 3/1978 | Beno | 333/262 |
| 4,211,987 | 7/1980 | Pan | 333/230 |
| 4,468,644 | 8/1984 | Teague et al. | 333/205 |
| 4,500,854 | 2/1985 | Meyer | 333/205 X |
| 4,619,001 | 10/1986 | Kane | 333/235 X |

FOREIGN PATENT DOCUMENTS

| | | |
|---|---|---|
| 0138438 | 4/1985 | European Pat. Off. . |
| 1523984 | 5/1968 | France . |

OTHER PUBLICATIONS

IEEE Transactions on Microwave Theory and Techniques, vol. MTT-33, No. 12, Dec. 1985, pp. 1416-1421, IEEE, N.Y., USA; C. Nguyen et al.: "On the analysis and design of spurline bandstop filters".

*Primary Examiner*—Marvin L. Nussbaum
*Attorney, Agent, or Firm*—Sughrue, Mion, Zinn, Macpeak & Seas

[57] ABSTRACT

A tuneable microwave filter comprises two branches of the same type each of which is connected to ground (22, 24) at each end and each of which includes a series-connected variable capacitance diode (13, 13A) controlled by a D.C. signal (V), said filter being disposed on the first face (9) of a plane substrate (8), with each branch comprising in series:

a micro-strip transmission line (11, 11A);

a second variable capacitance diode (12, 12A) situated between the first diode (13, 13A) and the micro-strip transmission line (11, 11A); and the input (E) and the output (S) of said filter taking place at the points interconnecting the micro-strip transmission lines (11, 11A) and the second variable capacitance diodes (12, 12A) of respective ones of the first and second branches. The filter is applicable, in particular, to space telecommunications.

6 Claims, 1 Drawing Sheet

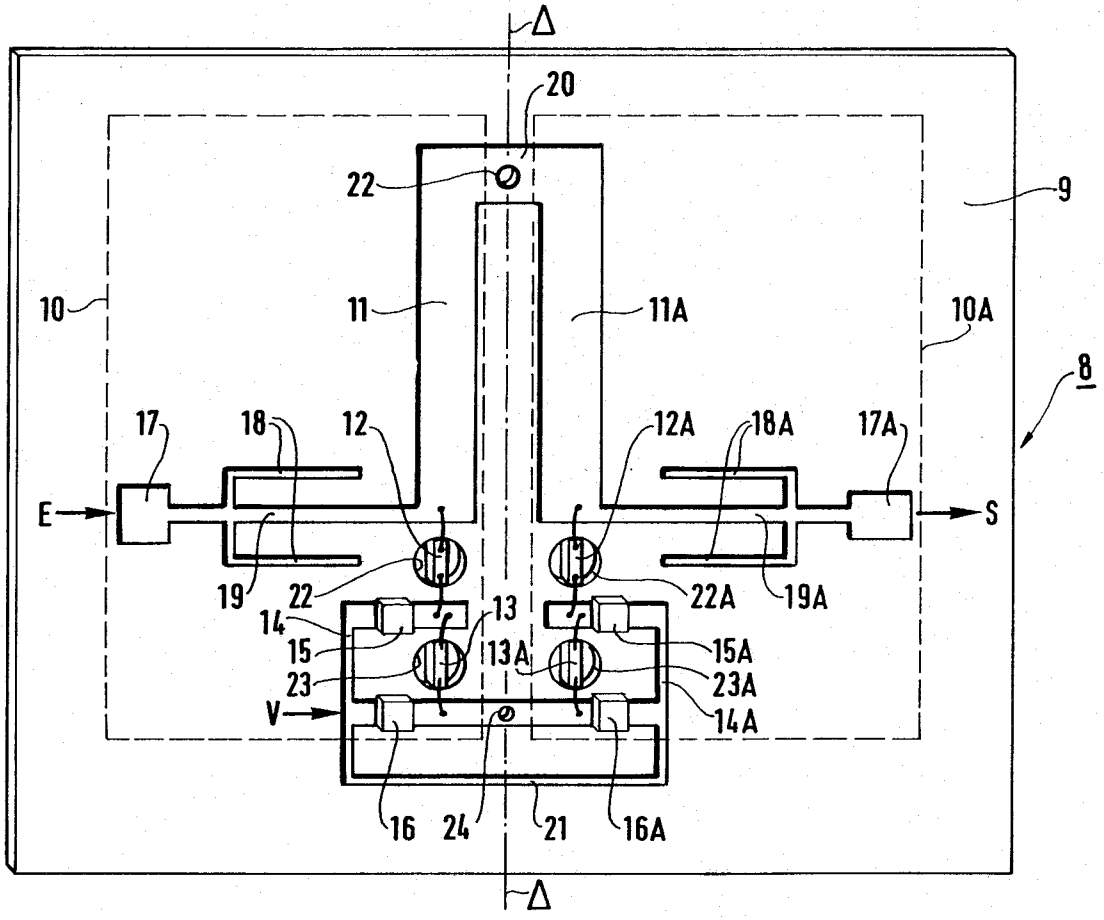
8
9
10A
S
17A
19A
18A
22A
15A
23A
14A
12A
11A
16A
20
Δ
21
Δ
13
13A
24
22
11
12
16
22
14
15
23
V
18
19
17
10
E

TUNEABLE MICROWAVE FILTER

The present invention relates to a tuneable filter, in particular for use in the 800 MHz to 1800 MHz band.

BACKGROUND OF THE INVENTION

In applications such as TVRO ("Television Reception Only"), and DATARO ("Data Reception Only"), the signal received at the antenna of the ground station lies in a band such as 10.95–11.7 GHz or 12.25–12.75 GHz or 11.7–12.5 GHz, etc. A first stage transposes these bands to the following RF (radio frequency) bands respectively: 950–1700 MHz, 950–1450 MHz, and 950–1750 MHz.

A second transposition moves these frequencies to lie about an intermediate frequency, or IF, at a few hundred MHz, for example 450 MHz.

Each channel in the RF band is a few tens of MHz wide. The tuneable filter serves to transmit only the selected channel into the total inlet RF bandwidth. As a result, the frequencies from the local oscillator (LO) of the last transposition stage together with the image frequencies and the mixing products are rejected much more effectively.

European Patent No. EP-0138438 describes a tuneable microwave filter comprising two branches of the same type, with each end of each branch being connected to ground and with each branch comprising a series connection of a fixed inductance, a first adjustable inductance, a first variable capacitance diode, a high frequency filter constituted by a series resonant circuit comprising a second variable capacitance diode and a second variable inductance, and a coupling element comprising a series inductance between the input point and the output point of the filter.

Because of the adjustable inductances, such a filter is not cheap.

The invention seeks to mitigate this drawback.

SUMMARY OF THE INVENTION

To this end, the present invention provides a tuneable microwave filter comprising two similar branches which are connected to ground at each end, and each of which includes a series connection of a first variable capacitance diode and a second variable capacitance diode controlled by a D.C. signal, said filter being disposed on the first face of a plane substrate, wherein each branch further includes a respective micro-strip transmission line disposed in series between its second diode and its first end, and wherein the microwave input and the microwave output are respectively connected via a symmetrical impedance matcher to the points which are common to the micro-strip transmission lines and to the second variable capacitance diodes of the first and second branches.

Such a filter has the major advantage of being easily made in reproducible manner, and is thus capable of automatic assembly. The cost price of such a filter is thus very low. It can therefore be used in a satellite receiver terminal intended for the general public.

Advantageously, the filter in accordance with the invention is made on a substrate whose second face is completely metallized and constitutes a ground plane, with the filter ground points being in the form of plated-through holes (PTH).

More precisely, a filter in accordance with the invention is such that each branch is D.C. powered via an RC filter, with said D.C. power supply being connected to the common point between the variable capacitance diodes via a micro-strip transmission line of length $(2k+1)\lambda/4$ and via the resistance of the RC filter, and to the ground end of the first variable capacitance diodes via the capacitance of the RC filter; a micro-strip transmission line of length $(2k'+1)\lambda/4$ connects both branches to the source of D.C. voltage.

Advantageously, the variable capacitance diodes are disposed in holes drilled through the substrate, thereby enabling them to be positioned with a high degree of accuracy.

BRIEF DESCRIPTION OF THE DRAWING

An embodiment of the invention is described by way of example with reference to the sole FIGURE of the accompanying drawing which is a plan view of a filter in accordance with the invention.

DESCRIPTION OF PREFERRED EMBODIMENT

This FIGURE shows a substrate 8 having a filter in accordance with the invention on a first face 9 thereof. The filter comprises two symmetrical portions or branches 10 (10A) about an axis Δ situated on the face 9 of the substrate 8.

Each portion (10, 10A) of the filter in accordance with the invention comprises:

a transmission line 11 (11A) extending parallel to the axis Δ and constituted by metallization on the surface of the substrate;

two variable capacitance diodes (varicaps) 12, 13 (12A, 13A) connected in series and disposed between the transmission line 11 (11A) and ground 24;

A transmission line 14 (14A) of length $(2k+1)\lambda/4$, where λ is the wavelength of the microwave signal under consideration, connected to a source V of D.C. for reverse biasing both varicaps 12, 13 (12A, 13A) via a resistance 15 (15A) and an isolating capacitance 16 (16A); and a 50 ohm impedance matching transmission line 17 (17A) connected to the common point between the transmission line 11 (11A) and the first varicap 12 (12A) via a symmetrical matcher 18, 19 (18A, 19A) constituted by two symmetrical stubs 18 (18A) extending parallel to the main arm 19 (19A).

In the first portion (10), this impedance matching transmission line 17 (17A) constitutes the input to which the microwave signal E is connected. In the second portion (10A) it constitutes the output from which the microwave signal S is obtained at the output from the filter in accordance with the invention.

The two transmission lines 11 and 11A, and the two portions 10 and 10A of the filter in accordance with the invention are coupled to one another and are connected at their ends via a length of transmission line 20 which is itself connected to ground 22.

The mid-point between the two varicaps 12A and 13A of the second portion is connected to the D.C. voltage source V via a transmission line 21 of length $(2k'+1)\lambda/4$.

The second face of the substrate is completely metallized. The grounding points are thus plated through holes 22 and 24.

The varicaps 12 (12A) and 13 (13A) are disposed in positioning holes 22 (22A) and 23 (23A).

The structure of the filter in accordance with the invention is made using micro-strip technology and the substrate used is, for example, glass epoxy, thereby reducing the cost price.

The filter is tuned by modifying the D.C. voltage applied to the varicaps 22, 23, 22A, and 23A. These varicaps may be made of silicon, for example, which is cheaper than using AsGa varicaps.

The isolating capacitances 16 (16A) and the resistances 15 (15A) serve to apply an impedance at the junction between the two varicaps 22 and 23 (22A and 23A) which is infinite at the microwave frequencies under consideration: they are constituted by surface-mounting components (SMC), thereby enabling the filter in accordance with the invention to be automatically mass produced, thereby reducing its cost price.

The varicaps are received in circular holes drilled through the substrate in order to improve assembly reproducibility, and as a result their connection leads are of substantially the same length from one assembly to another.

A filter in accordance with the invention is thus a two-pole filter in which each resonator is constituted by a transmission line, two varicaps, and the inductances due to the connection leads of the varicaps. The coupling between the two resonators takes place at the transmission line: the coupling between the two transmission lines 11 and 11A depends on their thickness, on their distance apart, and on their length.

By changing the dimensions of the filter, it is possible to design filters which are tuneable over different bands, and in particular over the 950–1750 MHz band.

The coupling between the resonators depends, by its very nature, on the operating frequency. By virtue of impedance inversion, the necessary filter function is not wide band, which would spoil the impedance matching within the tuning band with varying voltage applied to the varicaps. The purpose of the impedance matchers 18, 19 and 18A, 19A is to mitigate this drawback. These components and the symmetrical impedance matching serve to obtain wide band impedance matching which is conserved over substantially all of the frequency band under consideration.

The varicaps used may have a capacitance which varies, for example, from 18 pF to 2 pF for a control voltage V varying from 0 volts to 24 volts (at 500 kHz). The capacitance ratio which is 9 in this case, limits the band over which the filter can be tuned. By increasing this ratio it is possible to obtain filters which are tuneable over a wider band.

Naturally, the present invention has been described and shown purely by way of preferred example and its component parts could be replaced by equivalent parts, without thereby going beyond the scope of the invention.

We claim:

1. A tuneable microwave filter comprising a plane substrate having first and second faces and two similar filter branches disposed on said first face, each of said first and second branches comprising:

a first end connected to ground;

a second end connected to ground;

a first variable capacitance diode and a second variable capacitance diode connected in series between said first and second ends;

a microwave-strip transmission line disposed in series between said second diode and said first end; and a symmetrical impedance matcher for coupling microwave inputs and outputs to and from a common connection point between said second variable capacitance diode and said micro-strip transmission line.

2. A filter according to claim 1, wherein the second face of the substrate is completely metallized, and constitutes a ground plane, and wherein said first and second ends are grounded through ground connection points in the form of plated-through holes.

3. A filter according to claim 1, wherein a D.C. feed is connected to each branch via an RC filter.

4. A filter according to claim 3, wherein said D.C. feed is connected to a common point between the two variable capacitance diodes via a micro-strip transmission line of length $(2k+1)\lambda/4$ where $\lambda$ is the wavelength of the microwave signal under consideration, and via the resistance of the RC filter, and to the grounded end of the first variable capacitance diode via the capacitance of the RC filter, with a micro-strip transmission line of length $(2k'+1)\lambda/4$ connecting the second branch to the D.C. voltage source.

5. A filter according to claim 1, wherein each impedance matcher is constituted by a central arm and by two stubs forming two arms parallel thereto.

6. A filter according to claim 1, wherein the variable capacitance diodes are disposed in holes drilled through the substrate in such a manner as to enable them to be positioned with great accuracy.

* * * * *